US008055374B2

(12) United States Patent
Nedu

(10) Patent No.: US 8,055,374 B2
(45) Date of Patent: Nov. 8, 2011

(54) MACHINING QUALITY JUDGING METHOD FOR WAFER GRINDING MACHINE AND WAFER GRINDING MACHINE

(75) Inventor: Motoi Nedu, Tokyo (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 210 days.

(21) Appl. No.: 12/370,454

(22) Filed: Feb. 12, 2009

(65) Prior Publication Data

US 2009/0239448 A1 Sep. 24, 2009

(30) Foreign Application Priority Data

Mar. 21, 2008 (JP) ..... 2008-074009

(51) Int. Cl.
*G06F 19/00* (2011.01)

(52) U.S. Cl. ..... 700/164; 700/175

(58) Field of Classification Search ..... 700/164, 700/121, 170, 173

See application file for complete search history.

(56) References Cited

U.S. PATENT DOCUMENTS

| | | | | |
|---|---|---|---|---|
| 6,159,075 | A * | 12/2000 | Zhang | 451/8 |
| 6,594,542 | B1 * | 7/2003 | Williams | 700/164 |
| 6,835,116 | B2 * | 12/2004 | Oguri et al. | 451/8 |
| 7,037,184 | B2 * | 5/2006 | Petroski et al. | 451/532 |
| 2006/0009127 | A1 | 1/2006 | Sakurai et al. | |
| 2008/0242196 | A1 * | 10/2008 | Marxsen et al. | 451/8 |

FOREIGN PATENT DOCUMENTS

| | | |
|---|---|---|
| DE | 43 16 313 C1 | 12/1994 |
| EP | 1 738 871 A1 | 1/2007 |
| JP | 2001-291683 | 10/2001 |
| JP | 2003-071712 | 3/2003 |
| JP | 2005-21997 | 1/2005 |
| JP | 2005-342841 | 12/2005 |
| JP | 2006-35406 | 2/2006 |
| JP | 2007-175825 | 7/2007 |
| JP | 2007-301665 | 11/2007 |
| JP | 2007-335458 | 12/2007 |

OTHER PUBLICATIONS

Office action dated Mar. 22, 2010 cited in corresponding German Application No. 10 2008 060 199.3-43; 4pp.

Search Report dated Apr. 1, 2009, for corresponding Singapore Patent Application No. 200808159-8, listing the cited references.

Allowance of Patent issued in relation to the Korean Patent Application No. 109572/2008, dated Feb. 28, 2011, 3pp.

* cited by examiner

*Primary Examiner* — Ryan Jarrett
*Assistant Examiner* — Chad Rapp
(74) *Attorney, Agent, or Firm* — Christie, Parker & Hale, LLP.

(57) ABSTRACT

A machining quality judging method for a wafer grinding machine and wafer grinding machine are disclosed. The thickness of a wafer 2 is acquired from the feed amount of a grinding unit 3 while at the same time actually measuring the thickness of the wafer 2 appropriately. The wafer grinding machine includes a machining quality judging unit 20 for comparing the thickness of the wafer 2 based on the feed amount of the grinding unit 3 with the actually measured thickness of the wafer 2 and judges the machining quality of the ground surface of the wafer 2. Upon judgment of a machining failure, a command is issued to stop the back surface grinding operation.

4 Claims, 3 Drawing Sheets

MACHINING QUALITY JUDGING METHOD FOR WAFER GRINDING MACHINE AND WAFER GRINDING MACHINE

CROSS-REFERENCE TO RELATED APPLICATION

This application claims priority of Japanese Patent Application Number 2008-074009, filed on Mar. 21, 2008.

BACKGROUND OF THE INVENTION

1. Technical Field of the Invention

This invention relates to a machining quality judging method for a wafer grinding machine and wafer grinding machine.

2. Description of the Related Art

With an ever-increasing trend toward higher integration and packaging of semiconductor devices in recent years, semiconductor chips (dies) have been correspondingly reduced in thickness. As a result, the back surface of the wafer is ground by a grinding means before dicing. During the wafer back surface grinding process, the front surface of the wafer is protected by a protective tape attached thereon.

Further, it has become common practice to polish the back surface of the water that has been ground to remove distortion.

In the case where the wafer blank is hard and difficult to grind, for example, a grinding defect such as "surface burn" or "burr" may be caused, thereby making the desired grinding process difficult.

In view of this, Japanese Unexamined Patent Publication No. 2007-301665 proposes a grinding wheel having a grinding stone formed of a resin bonding agent mixed with abrasive diamond grains and micro metal balls.

The metal balls, which contact other objects comparatively softly, function as a buffer between the abrasive diamond grains and the wafer and has a cooling function due to the high heat conductivity on the other hand. These functions, coupled with the cutting function generated by the spherical metal balls dropping off which in turn causes the drop-off of the diamond abrasive grains, can contribute to an efficient grinding operation for the wafer of a hard-to-grind material without surface burn and burring.

Japanese Unexamined Patent Publication No. 2007-301665, does not disclose that the back surface of the wafer is monitored to execute the desired grinding process.

In the case where undesired grinding continues, a product defect cannot be avoided and yield is reduced.

SUMMARY OF THE INVENTION

This invention has been proposed to improve the problem described above, and the object thereof is to provide a machining quality judging method for a wafer grinding machine and the wafer grinding machine in which the wafer back surface is ground while comparing the wafer thickness based on the feed amount of a grinding means with the actual measurement of the wafer thickness thereby to judge a machining failure such as the surface burn of the grinding surface to prevent the occurrence of a product defect.

In order to achieve the object described above, according to a first aspect of the invention, there is provided a machining quality judging method for feeding and pressing the grinding means against the back surface of the wafer thereby to grind the back surface of the wafer, wherein the wafer grinding process is monitored in such a manner that the wafer thickness is acquired from the feed amount of the grinding means on the one hand and actually measured appropriately on the other hand, and by comparing the wafer thickness based on the grinding means feed amount and the wafer thickness based on the actual measurement are compared with each other thereby to judge the machining quality of the ground surface of the wafer, so that a command to stop the grinding operation is issued upon judgment that the machining process is a failure.

Therefore, in the wafer grinding process, a wafer machining failure can be judged in real time and a machining stop command can be immediately issued to prevent a product defect.

According to a second aspect of the invention, there is provided a machining quality judging method in which the wafer thickness is detected by a contact-type wafer thickness detection means based on a contact-type sensor.

The resulting accurate detection of the wafer thickness in real time contributes to a highly accurate machining quality judgment.

According to a third aspect of the invention, there is provided a grinding machine comprising a grinding means for holding and grinding a wafer, a feed means for feeding the grinding means for grinding operation, a detection means for actually measuring the wafer thickness as required, an arithmetic unit for monitoring the feed position of the grinding means by the feed means appropriately and calculating the feed amount of the grinding means, an acquisition unit for determining, based on the feed amount, the wafer thickness corresponding to the feed amount, and a machining quality judging unit for comparing the wafer thickness corresponding to the feed amount with the actual measurement of the wafer retrieved as a measurement signal from the detection means thereby to judge the machining quality of the ground surface of the wafer and issue a command to stop the grinding operation upon judgment of a machining failure.

The wafer thickness corresponding to the feed amount of the grinding means can thus be acquired. The wafer thickness thus acquired is compared with the wafer thickness actually measured as required.

In the case where a machining defect such as a surface burn occurs, the back surface area yet to be ground is increased as compared with the feed amount of the grinding means and the actual measurement of the wafer results in a different value.

A machining failure can be easily grasp from this deviation of the actual measurement.

By comparing the wafer thickness based on the feed amount of the grinding means with the actual measurement of the wafer thickness and determining a difference therebetween, therefore, a machining failure can be judged and a command can be issued to stop the back surface grinding process.

The present invention may be more fully understood from the description of preferred embodiments of the invention, as set forth below, together with the accompanying drawings.

DESCRIPTION OF THE PREFERRED EMBODIMENTS

Figure 1:
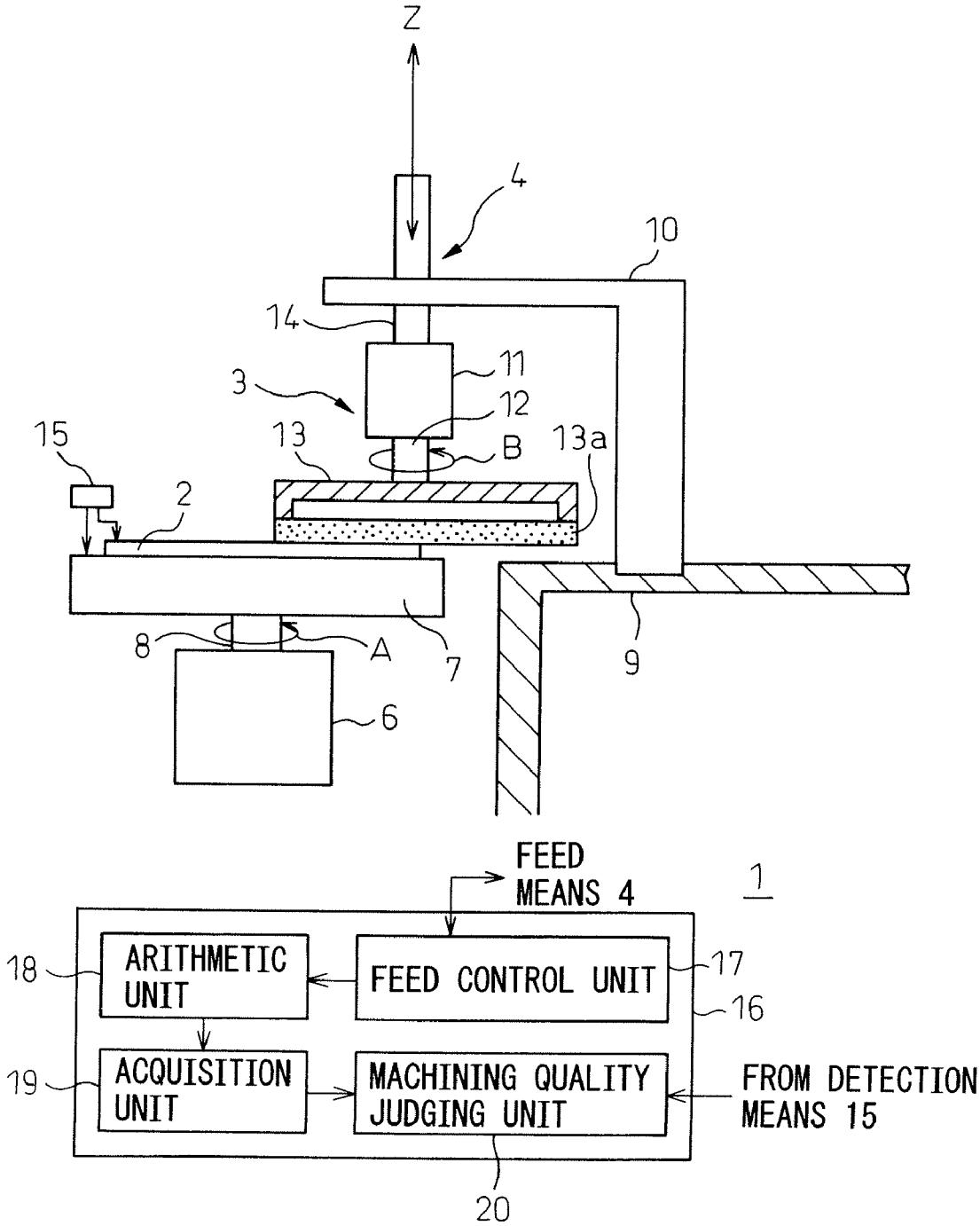
FIG. 1 is a diagram showing a system configuration of the essential parts as an example to explain the machining quality judging method for the wafer grinding machine according to this invention.

FIG. 1 shows an example of a semiconductor wafer grinding machine 1. This semiconductor wafer grinding machine 1 (hereinafter referred to as the grinding machine 1) includes a holding means (described later) for holding a wafer 2, a grinding means 3 for grinding the wafer 2 and a feed means 4 for feeding the grinding means 3 for grinding operation.

Figure 2:
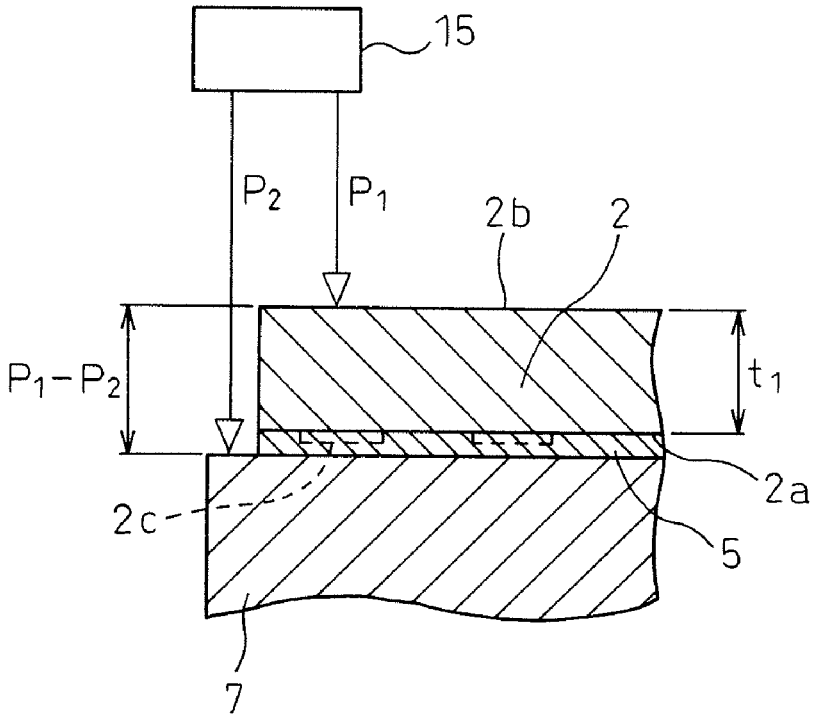
FIG. 2 is an enlarged sectional view of the essential parts for explaining an example of the wafer to be ground shown in FIG. 1 and a technique for measuring the thickness thereof.

The wafer 2, as shown in FIG. 2, is configured of a protective film 5 attached on the surface 2*a* formed with, for example, a circuit pattern 2*c*. Incidentally, the wafer 2 may alternatively be so configured that the protective film 5 is attached on the front surface 2*a* formed with the circuit pattern 2*c* and a support base member (not shown) is further attached thereon.

Wafer 2 is held by a holding means constituted of, for example, an adsorption plate (chuck), not shown, on the upper surface of a turn table 7 rotated by a motor 6. Incidentally, the turn table 7 is formed in the shape of a disk, and on the lower surface thereof, the output shaft 8 of the motor 6 is mounted on the same axis as the center axis of the turn table 7. This turn table 7 is rotated along the direction of arrow A by the drive force of the motor 6.

The thickness of wafer 2 is measured by a means described later. Before the grinding process, for example, the thickness t1 of the wafer 2 is about 750 μm and the thickness of the protective film 5 is about 100 μm.

The grinding means 3 described later is pushed in by the feed means 4 while being kept in contact with the back surface 2*b* constituting the surface of the wafer 2 to be ground, so that the wafer 2 is ground to a predetermined small thickness of about 30 μm.

The grinding means 3 is arranged at the forward end of a substantially L-shaped ram 10 erected on the machine body 9 and mounted on the feed means 4 reciprocable in the direction Z.

Specifically, the grinding means 3 has a grinding stone 13 mounted at the forward of the output shaft 12 of the motor 11 moved in axial direction by the shaft portion (described later) making up the feed means 4. In the process, the output shaft 12 of the motor 11 is mounted on the same axis as the center axis of the grinding stone 13 on the upper surface of the grinding stone 13, and rotated in the direction of arrow B by the drive force of the motor 11.

The grinding stone 13 is for grinding the back surface 2*b* of the wafer 2 held by adsorption on the turn table 7, and formed of, for example, a diamond with a liquid bonding agent as a coupling material. Due to the use of the liquid bonding agent as a coupling material, the grinding stone acquires the elasticity, which relaxes the shock when the grinding stone 13 and the wafer 2 come into contact with each other. Thus, the back surface 2*b* of the wafer 2 can be machined to high accuracy. The grinding stone 13 has the stone part 13*a* in opposed relation to the back surface 2*b* of the wafer 2 held by adsorption on the turn table 7.

Next, the feed means 4 for feeding the grinding means 3 while grinding the wafer 2 includes a ball screw 14, etc. The ball screw 14 is driven by a motor (not shown) through a feed control unit (described later). Then, the grinding stone 13 can be moved in the direction Z with respect to the wafer 2. By feeding the grinding stone 13 in pressure contact with the back surface 2*b* of the wafer 2, therefore, the back surface 2*b* of the wafer 2 can be ground with the grinding stone 13.

The ball screw 14 is fixed on an L-shaped ram 10. The ram 10, though of fixed type according to this embodiment, may alternatively be of movable type.

The grinding machine 1 configured as described above includes a detection means 15 as a control system such as a power controller for detecting, in real time, the thickness of the wafer 2 held by adsorption on the turn table 7 during the grinding process thereby to measure the thickness of the wafer 2. An example of the detection means 15 is a contact-type thickness detection means based on a contact-type sensor such as an in-process gauge.

The in-process gauge has a contactor as a probe, the change of which is converted into a voltage signal by a differential transformer, and based on the voltage signal thus converted, the distance between the upper surface of the turn table 7 and the back surface 2*b* of the wafer 2 (P1−P2), i.e. the thickness of the wafer 2 is measured in real time.

A noncontact-type sensor can also be employed as the detection means 15.

Specifically, a noncontact-type sensor operates in such a manner that the time of the infrared light reflection on the boundary surface between the wafer 2 and the protective film 5 is measured by taking advantage of the property of the infrared light to transmit through the metal, glass and plastics. As shown in FIG. 2, the IR (infrared ray) sensor can be used to measure the thickness t1 of the unit wafer.

This IR sensor is included in the grinding machine 1 to make up a control system together with a data analyzer, a stage unit having a probe or a power controller, not shown.

The control system of the grinding machine 1 is configured of a control unit 16 including a feed control unit 17, an arithmetic unit 18 for retrieving a signal associated with the operation amount of the motor from the feed control unit 17 for controlling the motor of the feed means 4 thereby to calculate the feed amount (the feed coordinate value in the direction Z) of the grinding means 3, an acquisition unit 19 for determining the thickness of the wafer 2 corresponding to the feed amount, and a machining quality judging unit 20 for comparing the thickness of the wafer 2 corresponding to the feed amount with the signal value of the actual measurement (P1−P2) retrieved from the detection means 15 for actually measuring the thickness of the wafer 2 thereby to judge the machining quality of the ground surface of the wafer 2 and issue a command to stop the back surface grinding operation upon judgment of a machining failure.

The arithmetic unit 18 determines the feed amount as $|Zo-Zt|$ from the difference between the position (coordinate value Zo) of the grinding means 3 in the initial stage of the grinding process and the feed position (coordinate value Zt) at an arbitrary time t elapsed from the start of the machining process.

The acquisition unit 19, on the other hand, extracts the thickness of the wafer 2 corresponding to $|Zo-Zt|$, for example, from the data stored in advance.

In the machining quality judging unit 20, the difference $\Delta=|Zo-Zt|-|P1-P2|$ is determined to compare the thickness of the wafer 2 corresponding to the feed amount with the actual measurement (P1−P2) of the thickness of the wafer 2 retrieved from the detection means 15, and whether this value Δ is within a predetermined range or not is monitored. Specifically, a variation of the value Δ, if any, during the grinding process would fail to grind the back surface 2*b* of the wafer 2 to be machined, for example, by the grinding stone 13 for some reason or other, and a machining failure such as a surface burn may be regarded to have occurred.

Then, the machining quality judging unit 20, upon detection of a variation of the value Δ, can issue a command to stop the operation of the grinding machine 1.

With regard to the grinding machine 1 having the configuration described above, the grinding process and the machine quality judgment process executed during the grinding process are explained below.

First, as shown in FIG. 2, the protective film 5 attached on the surface 2*a* of the wafer 2 to be machined is arranged down, and the wafer 2 is held on the upper surface of the turn table 7.

Next, the wafer 2 is rotated by the motor 6 on the one hand and the grinding stone 13 of the grinding means 3 mounted on the feed means 4 at the forward end of the ram 10 is rotated by the motor 11 on the other hand. Then, the feed control unit 17 issues a control command to supply power to the motor, so that the ball screw 14 is driven to move the grinding stone 13 downward.

The stone part 13*a* of the grinding stone 13 is brought into contact with the back surface 2*b* of the wafer 2, and the grinding stone 13 is moved down by the distance equivalent to a predetermined cut amount for each rotation of the turn table 7 thereby to grind the back surface.

During the back surface grinding process described above, the control system of the grinding machine 1 operates in such a manner that the position (the coordinate value in Z direction) of the stone part 13*a* of the grinding stone 13 in contact with the back surface 2*b* of the wafer 2 is retrieved from the feed control unit 17 appropriately as a signal associated with the motor operation amount from the start of the grinding process, so that the feed amount |Zo−Zt| (the feed coordinate value in Z direction) of the grinding means 3 is calculated by the arithmetic unit 18.

Then, the thickness of the wafer 2 corresponding to the feed amount |Zo−Zt| is extracted by the acquisition unit 19 from the data stored in advance.

In the machining quality judging unit 20, the difference Δ=|Zo−Zt|−|P1−P2| is determined to compare the thickness of the wafer 2 corresponding to the feed amount with the actual measurement (P1−P2) of the thickness of the wafer 2 retrieved from the detection means 15, and whether this value Δ is within a predetermined range or not is monitored.

In the case where the value Δ undergoes a change in the process, the back surface 2*b* of the wafer 2 to be machined by the grinding stone 13, for example, fails to be ground for some reason, and the machining quality judging unit 20 can decide that a machining failure such as a surface burn has occurred.

Then, the machining quality judging unit 20, based on the variation of the value Δ, can issue a command to stop the operation of the grinding machine 1 and stop the machining process.

In this way, a machining failure can be discovered in the stage of the machining process, and therefore, a product defect can be prevented by stopping the machining operation.

Upon normal completion of the grinding operation of the back surface 2*b*, the grinding stone 13 is moved back from the wafer 2, and the motor 11 is stopped to stop the rotation of the grinding stone 13. As a result, the grinding process of the grinding machine 1 is ended.

After the grinding process, the wafer is polished by a polishing machine, not shown, with the wafer 2 kept fixed on the turn table 7 to remove the damaged layer, etc. As a result, the damage such as an undue cracking of the wafer 2 is prevented. The wafer 2 completely polished is removed from the turn table 7 and transferred to the next step such as the wafer processing step for coating or dicing.

As described above, in the grinding machine 1 for the wafer 2 according to this embodiment, the wafer thickness based on the feed amount of the grinding means is compared with the wafer thickness actual measured in real time during the machining process. Thus, the machining failure such as a surface burn of the grinding surface can be immediately detected, and by issuing a machining stop command, a product defect can be prevented.

Figure 3:
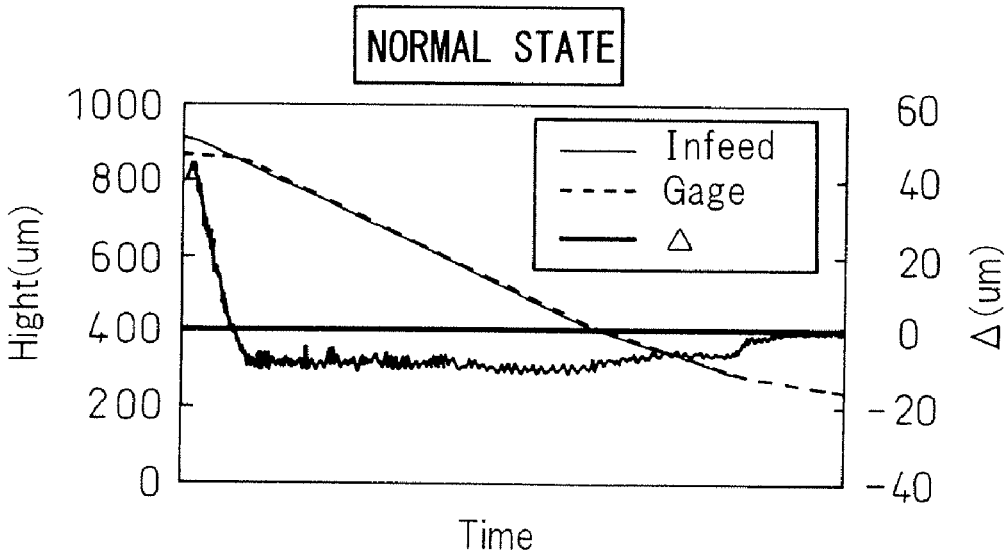
FIG. 3 is a graph showing an example of the relation between the feed coordinate value (conversion value) of the grinding stone and the wafer thickness (actual measurement) measured by a contact-type thickness detection means during the satisfactory grinding process.
Figure 4:
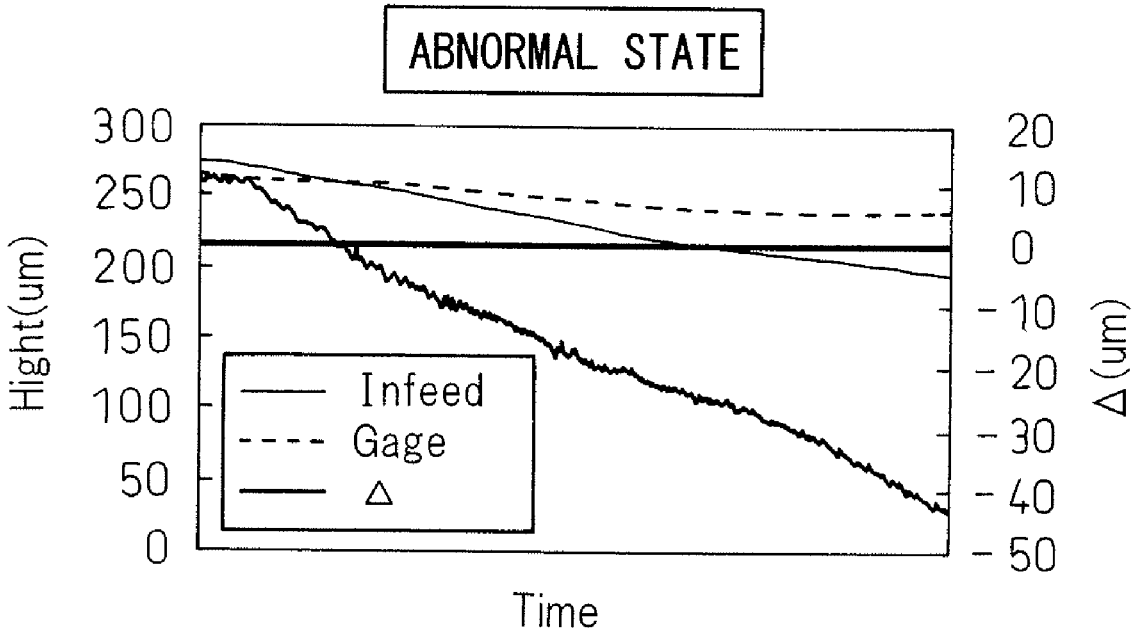
FIG. 4 is a graph showing an example of the relation between the feed coordinate value (conversion value) of the grinding stone and the wafer thickness (actual measurement) measured by a contact-type thickness detection means upon occurrence of a machining failure.

Now, FIGS. 3 and 4 show the relation between the feed coordinate value (conversion value) of the grinding stone and the wafer thickness value (actual measurement) measured by a contact-type thickness detection means.

FIG. 3 shows the state in which the grinding process is normally executed, and FIG. 4 the state in which the grinding process is not executed normally.

As easily understood from FIGS. 3 and 4, as long as the grinding process is executed normally, the deviation is minimum between the feed coordinate value (conversion value) and the wafer thickness value (actual measurement) measured by a contact-type thickness detection means, and therefore, the value Δ is kept at a minimum. Thus, assuming that the value Δ is less than a predetermined value (20 μm), for example, the machining process can be judged as satisfactory.

If a machining failure, such as a surface burn, occurs it is understood that a deviation has occurred between the feed coordinate value (conversion value) and the wafer thickness value (actual measurement) measured by a contact-type thickness detection means, and therefore, and the value Δ increases with time. This state can be judged as a machining failure such as a surface burn.

This invention is not of course limited to the embodiments described above.

The in-process gauge used as the detection means 15, for example, may be replaced with any other measuring means which can measure the back surface position of the wafer 2 fixed on the turn table 7.

The embodiments described above also represent a case in which the IR sensor is used as an example of the noncontact-type detection means constituting the detection means 15. Nevertheless, any other noncontact-type sensor, or contact-type sensor if possible, capable of measuring the thickness t1 of the wafer 2 as a unit during the grinding process can be employed with equal effect.

While the invention has been described by reference to specific embodiments chosen for purposes of illustration, it should be apparent, to those skilled in the art, that numerous modifications could be made thereto without departing from the basic concept and scope of the invention.

The invention claimed is:

1. A machining quality judging method for a wafer grinding machine for grinding a back surface of a wafer with a grinding unit fed and pressed against the back surface of the wafer, comprising:

calculating a feed amount of the grinding unit during a grinding process;

acquiring a wafer thickness from previously stored data during the grinding process, the wafer thickness corresponding to the feed amount of the grinding unit;

measuring an actual wafer thickness during the grinding process;

comparing the wafer thickness corresponding to the feed amount of the grinding unit with the actual wafer thickness; and monitoring whether a difference between the wafer thickness corresponding to the feed amount of the grinding unit and the actual wafer thickness is within a predetermined range during the grinding process to judge a machining quality for the back surface of the wafer.

2. The machining quality judging method for the wafer grinding machine according to claim 1, wherein the actual wafer thickness is measured by a contact-type wafer thickness detection unit based on a contact-type sensor.

3. A wafer grinding machine comprising:

a grinding unit for holding and grinding a wafer;

a feed unit for feeding the grinding unit for grinding operation;

a detection unit for measuring an actual wafer thickness during a grinding process;

an arithmetic unit for calculating a feed amount of the grinding unit during the grinding process;

an acquisition unit for acquiring a wafer thickness from previously stored data during the grinding process, the wafer thickness corresponding to the feed amount of the grinding unit; and a machining quality judging unit for comparing the wafer thickness corresponding to the feed amount of the grinding unit with the actual wafer thickness measured by the detection unit and monitoring whether a difference between the wafer thickness corresponding to the feed amount of the grinding unit and the actual wafer thickness is within a predetermined range during the grinding process to judge a machining quality for the back surface of the wafer.

4. The wafer grinding machine according to claim 3, wherein the detection unit is configured to measure the actual wafer thickness corresponding on a contact-type sensor.

* * * * *